US005799224A

United States Patent [19]

Verlinden et al.

[11] Patent Number: 5,799,224

[45] Date of Patent: Aug. 25, 1998

[54] PHOTOGRAPHIC SHEET MATERIAL PROCESSING APPARATUS AND A METHOD OF CLEANING

[75] Inventors: Bart Verlinden, Tongeren; Jan Claes, Mortsel, both of Belgium

[73] Assignee: Agfa-Gevaert N.V., Mortsel, Belgium

[21] Appl. No.: 720,246

[22] Filed: Sep. 26, 1996

Related U.S. Application Data

[60] Provisional application No. 60/008,588, Dec. 13, 1995.

[30] Foreign Application Priority Data

Oct. 17, 1995 [EP] European Pat. Off. ..... 95202799

[51] Int. Cl.[6] ..... G03D 3/08; G03D 3/02

[52] U.S. Cl. ..... 396/619; 396/622; 396/630; 396/636

[58] Field of Search ..... 396/612, 624, 396/626, 630, 636, 622; 134/64 P, 64 R, 122 P, 122 R

[56] References Cited

U.S. PATENT DOCUMENTS 4,166,689 9/1979 Schausberger et al. ..... 396/614

4,650,308 3/1987 Burbury ..... 396/626

FOREIGN PATENT DOCUMENTS 3804591 8/1989 Germany .

OTHER PUBLICATIONS

Patent Abstracts of Japan, vol. 012, No. 468 (p.-797), Dec. 8, 1988 and JP-A-63 187243 (Fuji Photo Film Co., Ltd.), Aug. 2, 1988.

Patent Abstracts of Japan, vol. 17, No. 498 (p.-1609), Sep. 8, 1993 and JP-A-05 127338 (Fuji Photo Film Co., Ltd.), May 25, 1993.

*Primary Examiner*—D. Rutledge

*Attorney, Agent, or Firm*—Baker & Botts, L.L.P.

[57] ABSTRACT

A photographic sheet material processing apparatus has a plurality of treatment cells (12', 12", 12'") mounted one above another in a vertical stack to define a substantially vertical sheet material path (20) through the apparatus. The apparatus is cleaned by feeding a cleaning liquid to a first cell (12'), allowing at least a portion of said cleaning liquid to pass by gravity from said first cell (12') to at least one further cell (12"), and discharging said cleaning liquid from the apparatus. This process provides a convenient and efficient method of cleaning a vertical photographic sheet material processing apparatus.

11 Claims, 3 Drawing Sheets

PHOTOGRAPHIC SHEET MATERIAL PROCESSING APPARATUS AND A METHOD OF CLEANING

DESCRIPTION

This application claims the benefit of Provisional application Ser. No. 60/008,588, filed Dec. 13, 1995.

FIELD OF THE INVENTION

The present invention relates to an apparatus for the processing of photographic sheet material, such as X-ray film, pre-sensitised plates, graphic art film and paper, and offset plates. More particularly the invention relates to a method of cleaning such an apparatus.

BACKGROUND OF THE INVENTION

As a rule, a processing apparatus for photographic sheet material comprises several treatment cells, most or all of which are in the form of vessels containing a treatment liquid, such as a developer, a fixer or a rinse liquid. As used herein, the term "sheet material" includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus.

In a vertically oriented apparatus, it is important to avoid, or at least minimise leakage of treatment liquid from one vessel to another and carry-over as the sheet material passes through the apparatus. United States patent U.S. Pat. No. 4,166,689 (Schausberger et al. assigned to Agfa-Gevaert AG) describes such an apparatus in which liquid escapes form the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

From time to time it is necessary to clean the processing apparatus, in order to remove debris which may derive from the sheet material itself and deposits derived from the treatment liquids. The usual process for cleaning a processing apparatus, whether of the vertical or horizontal configuration, is to drain the treatment liquids and to flush the apparatus through with cleaning liquid. Water, optionally containing various additives and optionally at an elevated temperature, is the usual cleaning liquid. For environmental reasons, there is a desire to reduce the use of all raw materials used in a processing machine, including water and this is particularly the case where the apparatus is being used in an area where there is a shortage of water.

SUMMARY OF THE INVENTION

It is an object of the present invention to provide convenient and efficient method of cleaning a vertical photographic sheet material processing apparatus.

It is a preferred object of the present invention to carry out such a cleaning method in an automatic manner.

According to a first aspect of the invention there is provided a method of cleaning a photographic sheet material processing apparatus having a plurality of treatment cells mounted one above another in a vertical stack to define a substantially vertical sheet material path through the apparatus, the method being characterised by the steps of:

(i) draining treatment liquid from the cells;

(ii) feeding a cleaning liquid to a first cell;

(iii) allowing at least a portion of the cleaning liquid to pass by gravity from the first cell to at least one further cell; and (iv) discharging the cleaning liquid from the apparatus.

According to a second aspect of the invention, there is provided a photographic sheet material processing apparatus having a plurality of treatment cells mounted one above another in a vertical stack to define a substantially vertical sheet material path through the apparatus, characterised by means for feeding cleaning liquid to a first cell, means for allowing at least a portion of the cleaning liquid to pass by gravity to a further cell and means for discharging the cleaning liquid from the apparatus.

Preferably, at least one of the treatment liquids is drained into a container, to be re-used after cleaning is complete. This feature enables the overall cleaning process to be speeded up. A suitable such container is a flexible container, from which air may be excluded, to reduce the effects of oxidation.

The cleaning liquid is preferably caused to pass to each cell in the stack in turn, from the top-most cell to the bottom-most cell.

In a preferred embodiment of the invention, the film path extends in a downwards direction, that is the sheet material developing cell is located above the sheet material fixing cell. This orientation removes the risk that the fixer may contaminate the developer. The invention is also applicable to apparatus in which the film path extends in an upwards direction, but in this case cleaning liquid should be prevented from passing from the sheet material fixing cell to the sheet material developing cell.

In one embodiment, the first cell is a photographic sheet material developing cell and the further cell, i.e. the next cell to be cleaned, is a photographic sheet material fixing cell. A cell adapted for the rinsing of the photographic sheet material may follow.

Preferably, all the cleaning liquid in the first cell is allowed to pass by gravity to the next cell to be cleaned.

However, where the cells are of different liquid capacity, it is possible that only part of the cleaning liquid is passed from the first cell to the next cell to be cleaned, the remaining cleaning liquid being discharged or, better, fed to another cell to be cleaned.

The cleaning liquid may be heated before being fed to the first cell and/or before being fed to the at least one further cell although it is preferred to heat the cleaning liquid either in one or more of the cells, especially the first cell, or as it is being circulated there-through.

The cleaning liquid may comprise water and will usually consist of substantially pure water, although water-miscible organic solvents such as lower alcohols, and surface active agents, may also be present in the cleaning liquid. In a particularly preferred embodiment, the cleaning water comprises recovered water, for example water recovered by condensation of moisture driven off from processed sheet material in a drying unit, or water recovered from spent treatment liquids by reverse osmosis separation.

The cleaning liquid is preferably circulated through the first cell before being allowed to pass by gravity to the next cell to be cleaned. For this embodiment, the cell is preferably provided with both a liquid inlet passage and a liquid outlet passage to enable the cleaning liquid to be circulated continuously through the cell for a predetermined period of time, before being allowed to pass to the next cell to be cleaned.

The cleaning liquid is fed to the first cell and is preferably circulated through the cell with the aid of the circulation pump for that cell. This feature enables the circulation pumps to be cleaned with the cleaning liquid while the cells are being cleaned. In the case where a number of cells constitute a treatment liquid cascade, with one or more volumetric pumps between the cells, it is possible to additionally feed cleaning liquid to one such cell and transfer the cleaning liquid to another such cell by using the volumetric pump. Depending upon the configuration of these cells, the volumetric pump may need to operated in reverse mode. Where the transfer of cleaning liquid from one cell to another by gravity or by the use of the cascade pumps is not possible, additional pumps may be provided for this purpose.

The next cell to be cleaned may be the next lower cell, or one or more lower cells may be omitted from the cleaning method. Cells may be omitted for example, where they are not liquid-containing cells where build up of debris and deposits is less severe. Where however the next cell to be cleaned is the next lower cell, at least the first cell may comprise valve means, the method including the step of opening the valve means to allow cleaning liquid to pass by gravity to the next lower cell. The valve means may be closed prior to cleaning liquid being fed to the associated cell.

The valve means may be constituted by a roller which, in a processing mode of the apparatus, is in contact with a reaction surface to define a nip through which the sheet material passes during processing, the valve means being opened during a cleaning mode of the apparatus by moving the roller away from the reaction surface. Preferably, the reaction surface is constituted by the surface of a further roller.

The or each roller may be associated with sealing means which provides a seal between the surface of the roller and the housing of the associated cell. When the roller and the reaction surface are moved apart, the roller surface may maintain contact with the sealing means, depending upon the construction of the latter, or may separate therefrom.

In one embodiment of the valve means, the processing rollers are rotatable on respective roller shafts, the rollers being biased together. At least one end of the first roller shaft is provided with a rotational drive means for transporting the sheet material in the processing direction. At each end of the second roller shaft displacement means are provided, for relative displacement of the second roller away from and to the first roller.

In an alternative embodiment of the valve means, the processing rollers are rotatable on respective roller shafts. Co-operating cams are provided at each end of the roller shafts. The cams on the first roller shaft are circular cams, fixedly secured to the roller shafts. The cams on the second shaft are eccentric cams, connected to the second shaft by way of a one-way clutch. In the normal direction of rotation of the rollers, the eccentric cam is free to rotate relative to the second roller shaft. However, if the direction of rotation of the second roller shaft is reversed, the one-way clutch engages to rotationally secure the eccentric cam to the second roller shaft. Rotation of the eccentric cam in this reverse direction causes the rollers to move away from each other. Where such a construction of the valve means is provided for a number of cells, the one-way clutches may be set in relation to each other to open the rollers of these cells in sequence. To open the valve means in sequence, it is then simply necessary to drive the rollers step-wise in the reverse direction. An encoder on the shaft of the drive motor may be provided to assist the control of this operation.

In a preferred embodiment of the apparatus, each cell comprises a housing within which is mounted a rotatable roller biased towards a reaction surface to define a roller nip there-between through which the sheet material path extends and associated sealing means serving to provide a gas- and liquid-tight seal between the roller and reaction surface on the one hand and a wall of the housing on the other.

The reaction surface towards which the roller is biased to define the nip will usually be the surface of another roller, or the reaction surface may be in the form of a belt or a fixed surface with a low friction coefficient. Where this general description refers to the use of a roller pair, it is to be understood that the second roller may be replaced by any other reaction surface, such as those referred to above.

By the term "roller shaft" at least three different mechanical possibilities are included, namely a) the case of a roller shaft intrinsically belonging to the roller, b) the case of a roller shaft entirely mounted through the axis of the roller, and c) the case of a roller shaft separately mounted in an end flange of the roller.

The process of the invention may be carried out manually or automatically. In the automatic option, suitable control means such as a micro-processor may be provided to control the steps of the cleaning process, and even to initiate cleaning after the apparatus has been used to process a predetermined quantity of photographic sheet material and/or after a predetermined period of time following a previous cleaning. Some cells of the apparatus may require cleaning more often than others. This information can be held within the micro-processor to enable the cleaning process to be modified from time to time according to need.

After the cleaning liquid has passed through all the cells to be cleaned, it is discharged from the apparatus. The discharged cleaning liquid may be discarded, water may be recovered therefrom or it may be re-used for cleaning the same or different cells in a subsequent cleaning process. However, the subsequent cleaning of a sheet material developing cell with cleaning liquid previously used for cleaning a sheet material fixing cell should be avoided.

It will be usual that most, if not all, of the cells in the stack are in the form of a vessels, suitable for containing treatment liquid, the rollers and sealing means serving to retain treatment liquid in the vessel. Other cells may not contain processing liquid, these cells providing, for example, a dead space where diffusion reactions can occur on the sheet material as it passes there-through. The top-most cell may, however, not be a liquid-containing vessel, serving simply as the gas-tight cover for the apparatus.

It is desirable that the gas- and liquid-tight seal between the rollers and the housing wall is achieved by a construction in which each roller is in sealing contact along its length, at least between the limits of the nip, with a stationary sealing member. The sealing member preferably includes a portion which extends longitudinally along the surface of the associated roller, in a straight line parallel to the associated roller axis and preferably contacts the surface of the associated roller at a location which is between 45° and 225°, most preferably between 80° and 100° from the centre of the nip, on the fluid side. The sealing member may be carried on a sealing support, secured to the housing wall of the cell.

The sealing member may be in a unitary or composite form which exerts a spring force of between 2 and 500 g/cm of roller, perpendicular to the roller surface. The spring loading may be derived from the geometry of a unitary sealing member, from a separate spring incorporated in a composite sealing member or simply from the compression of the elastomeric material covering the roller. The sealing member material which is in contact with the associated roller surface preferably has a coefficient of friction (as measured against stainless steel) of from 0.05 to 0.3, preferably from 0.09 to 0.2. The sealing member material in contact with the associated roller surface may comprise a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof. We prefer to use a PTFE profile backed with a stainless steel spring.

Typical rollers have a core provided with a covering of elastomeric material, although it is possible for the roller to be elastomeric throughout its cross-section. The elastomeric material may be selected from ethylene/propylene/diene terpolymers (EPDM), silicoNe rubber, polyurethane, thermoplastic rubber such as Santoprene (Trade Mark for polypropylene/EPDM rubber), styrene-butyl rubber and nitrile-butyl rubber. The hardness of the elastomeric material may be between 15 Shore (A) and 90 Shore (A), as measured on the roller surface. In one embodiment of the invention, the diameter of the elastomeric material covering is constant along the length of the roller. Alternatively the roller may have a radial dimension profile which varies along the length thereof. Alternatively or additionally, the diameter of the core varies along the length thereof.

Suitable materials for the rigid core include metals, such as stainless steel, non-ferrous alloys, titanium, aluminium or a composite thereof.

In one embodiment of the invention, the core is hollow. Alternatively the core may be solid.

The rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

The roller is preferably a drive roller for driving sheet material through the apparatus, but it may alternatively be a freely rotating roller, the cell being provided with alternative drive means for driving the photographic sheet material there-through.

In preferred embodiments of the present invention, there are provided means for connecting each cell to adjacent cells in the stack in a closed manner. By the term "closed manner" in this specification is meant that each cell is so connected to adjacent cells that no cell is open to the environment.

The housing wall of each cell may comprise an upper housing wall part so shaped in relation to the lower housing wall part of the next higher cell as to provide a substantially closed connection between adjacent cells. For example, the upper and lower housing wall parts may be provided with flanges, means being provided to secure the flange of the upper housing wall part with the flange of the lower housing wall part of the next higher cell thereby to provide the substantially closed connection.

A lower part of the housing wall of each liquid-containing cell or vessel may be so shaped as to define a leakage tray so positioned that any treatment liquid which passes, for example, through the nip drips into the leakage tray, for collection and recirculation as desired.

Each cell may be of modular construction and provided with means to enable the cell to be mounted directly above or below an identical or similar other cell. Alternatively, the apparatus may take an integral or semi-integral form in which the means for connecting each cell to adjacent cells in the stack in a closed manner is constituted by a common housing wall of the apparatus. By the term "semi-integral form" we intend to include an apparatus which is divided by a substantially vertical plane passing through all the vessels in the apparatus, particularly the plane of the sheet material path, enabling the apparatus to be opened-up for servicing purposes, in particular to enable easy access to the rollers.

By the use of a vertical configuration, the cross-section of the cell can be low, such as less than 3 times the roller diameter. The volume of the cell can therefore be low. Indeed, for a given sheet material path length, the volume of one vessel of a vertical processing apparatus can be many times smaller than the volume of an equivalent treatment bath in a horizontal processing apparatus. This has advantages in terms of the volume of water needed for cleaning the cells but also in terms of the volume of treatment liquids used and the efficiency of their interaction with the sheet material.

In a preferred embodiment of the invention, all the treatment cells are arranged one above another in the stack. In an alternative arrangement, some of the treatment cells are arranged one above another in a stack to define a substantially vertical sheet material path, while remaining treatment cells are arranged one beside another in a sequence to define a substantially horizontal sheet material path, continuous with the vertical sheet material path.

Further treatment cells may follow arranged in a second vertical configuration, i.e. the arrangement may comprise a first vertical apparatus, followed by a horizontally configured apparatus, which in turn is followed by a second vertically oriented apparatus. In this arrangement, the first vertical processing apparatus may be adapted for the development of images on the photographic sheet material, the horizontal processing apparatus may be adapted for the fixing of developed images on the photographic sheet material and the second vertical processing apparatus may be adapted for the cascade washing of the photographic sheet material.

In addition to the rollers and associated sealing means, one or more of the cells of the apparatus may include additional features if desired. Cleaning means such as cleaning rollers or cleaning brushes may be provided for acting upon the rollers to assist the removal of debris therefrom, as described in European patent application EP 93202862 (Agfa-Gevaert NV), filed 11 Oct. 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Spray means may be provided for applying treatment liquid to the sheet material. Guide means may be included for guiding the passage of the sheet material through the apparatus. Heating means may be provided in one or more cells so that the cell becomes a sheet material drying unit, rather than a wet treatment unit. While liquid pumping, heating, cooling and filtering facilities will normally be provided outside the cells, it is possible for some elements of these features to be included in the cells themselves. Any combination of these additional features is also possible.

BRIEF DESCRIPTION OF THE DRAWINGS

The invention will now be further described, purely by way of example, by reference to the accompanying drawings in which.

PREFERRED EMBODIMENTS OF THE INVENTION

Although only one specific embodiment of a treatment cell according to the invention is shown in the FIGS., the invention is not restricted thereto. The apparatus for the wet processing of photographic sheet material such as X-ray film as shown in the FIGS. comprises a plurality of treatment cells 12', 12", 12'" mounted one above another. These cells may be arranged to provide a sequence of steps in the processing of sheet photographic material, such as developing, fixing, rinsing and drying. The cells may be of a modular structure as shown or may be part of an integral apparatus.

Figure 1:
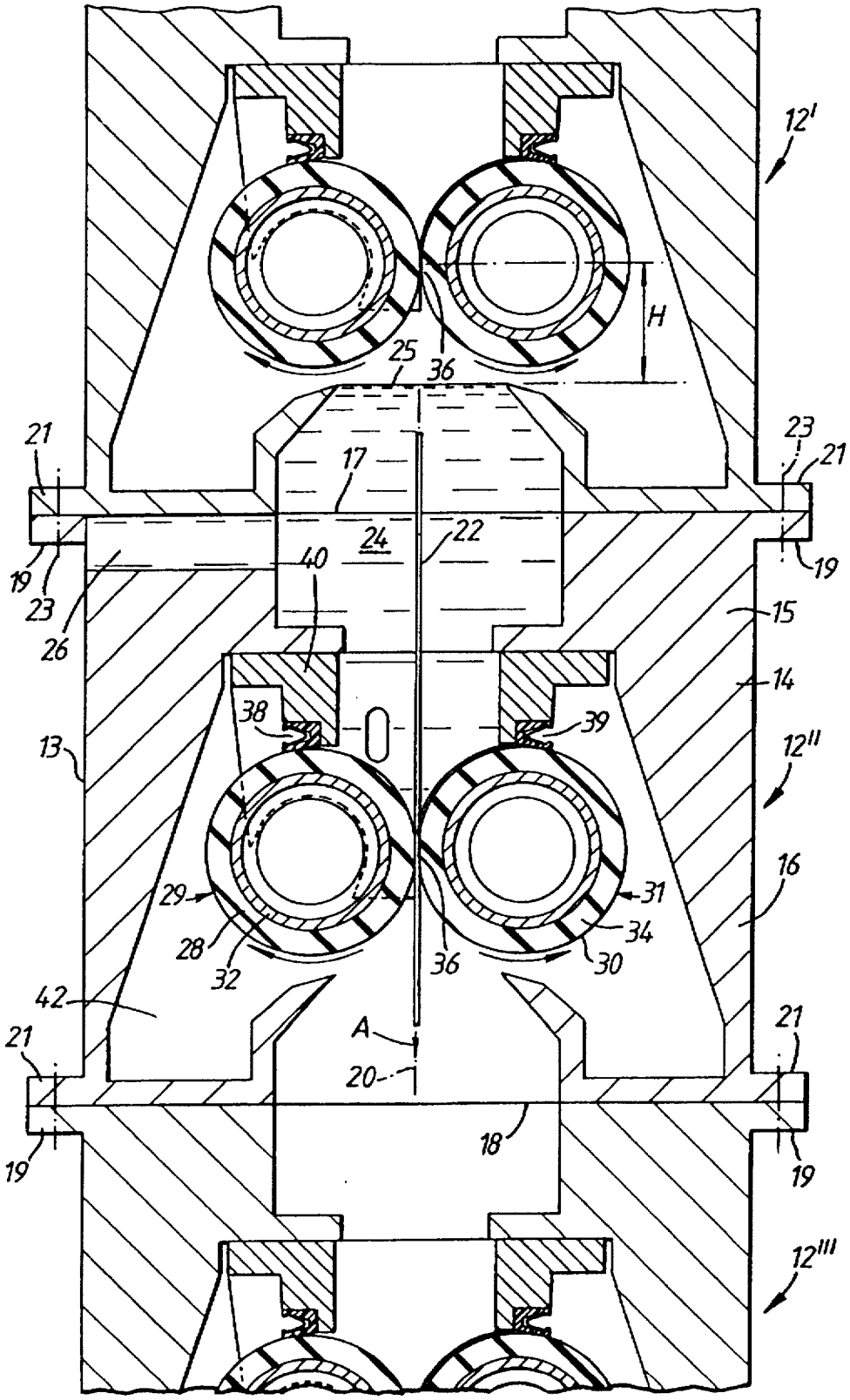
FIG. 1 is a cross-sectional view of one cell of a vertical processing apparatus according to the invention, with adjacent cells being partly shown.

FIG. 1 shows that the cell 12" is in the form of a vessel 13 which is of generally rectangular cross-section comprising a housing defined by a housing wall 14 so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 13, the sheet material 22 moving in a downwards direction as indicated by the arrow A. Mounted within the cell 12" are a pair of rotatable drive rollers 28, 30. The vessel 13 contains treatment liquid 24, a passage 26 through the housing wall 14 being provided as an inlet for the treatment liquid 24. The distance H between the surface 25 of the liquid 24 and the nip of the rollers of the next upper cell 12' is as low as possible.

Each roller 28, 30 is of the squeegee type comprising a stainless steel hollow core 32 carrying an elastomeric covering 34. The core 32 is in cylindrical form having constant internal and external diameters along the length thereof. The rollers 28, 30 are biased towards each other with a force sufficient to effect a liquid tight seal but without causing damage to the photographic sheet material 22 as it passes there-between. The line of contact between the roller surfaces 29 and 31 defines a nip 36. The sheet material preferably has a width which is at least 10 mm smaller than the length of the nip, so as to enable a spacing of at least 5 mm between the edges of the sheet and the adjacent limit of the nip 36, thereby to minimise leakage. The rollers 28, 30 are coupled to drive means (not shown in FIG. 1) so as to constitute drive rollers for driving the sheet material 22 along the sheet material path 20.

Each roller 28, 30 is in sealing contact along its length, with a respective stationary sealing member 38, 39 carried on a sealing support 40, which in turn is secured to the housing wall 14 of the vessel 13, the sealing members 38, 39 serving to provide a gas- and liquid-tight seal between the rollers 28, 30 on the one hand and the housing wall 14 on the other. The treatment liquid 24 is therefore retained in the vessel 13 by the rollers 28, 30 and the sealing members 38, 39. The sealing members 38, 39 are formed of PTFE and are secured to the sealing support 40 by a suitable, water- and chemical-resistant adhesive, such as a silicone adhesive.

The rollers 28, 30 are mounted in such a manner as to be capable of moving apart, as shown in detail in FIGS. 2, 3 and 4 described below. The roller pair 28, 30 together with associated sealing means 38, 39 in each of the cells 12', 12" and 12'" thereby constitute a valve. Thus, the rollers of each roller pair 28, 30 are in contact with each other in the processing mode of the apparatus to close as a valve but are capable of being moved apart during a cleaning mode of the apparatus to open the valve, as described in more detail below.

The upper and lower housing wall parts 15, 16 are provided with flanges 19, 21 respectively provided with bolts indicated by broken lines 23 to enable the cell 12" to be mounted directly below and above identical or similar other cells 12', 12'", as partly indicated FIG. 1. In the illustrated embodiment, the adjacent cells 12' and 12'" are both liquid containing cells, the first cell 12' being a photographic sheet material developing cell, the second cell 12" being a photographic sheet material fixing cell and the third cell 12'" being a rinsing cell.

The upper housing wall part 15 of cell 12" is so shaped in relation to the lower housing wall part 16 as to provide a substantially closed connection between adjacent cells. Thus, treatment liquid from vessel 13 is prevented from falling into the lower cell 12'" by the rollers 28, 30 and sealing members 38, 39, while vapours from the lower cell 12'" are prevented from entering the vessel 13 or escaping into the environment.

The lower part 16 of the housing wall 14 is so shaped as to define a leakage tray 42. Any treatment liquid which may pass through the roller nip 36, in particular as the sheet material 22 passes therethrough, drips from the rollers and falls into the leakage tray 42 from where it may be recovered and recirculated as desired.

After draining the treatment liquids into containers, such as flexible containers for later re-use, the apparatus is cleaned by feeding water to the first cell 12' and circulating the water through the first cell while heating it to a desired cleaning temperature. The valve, constituted by the roller pair 28, 30, is now opened to allow the cleaning water to pass by gravity from the first cell 12' to the second cell 12". The cleaning water is then circulated through the second cell 12", allowed to pass by gravity from the second cell 12" to the third cell 12'", circulated through the third cell 12", and then discharged from the apparatus.

The cleaning water is thus caused to pass to each cell 12', 12", 12'" in the stack in turn, from the top-most cell 12' to the bottom-most cell 12'".

The cleaning method includes the step of opening the valve to allow cleaning liquid to pass by gravity to the next lower cell 12". The valve is opened during a cleaning mode of the apparatus by moving the rollers of the roller pair 28, 30 apart.

Figure 2:
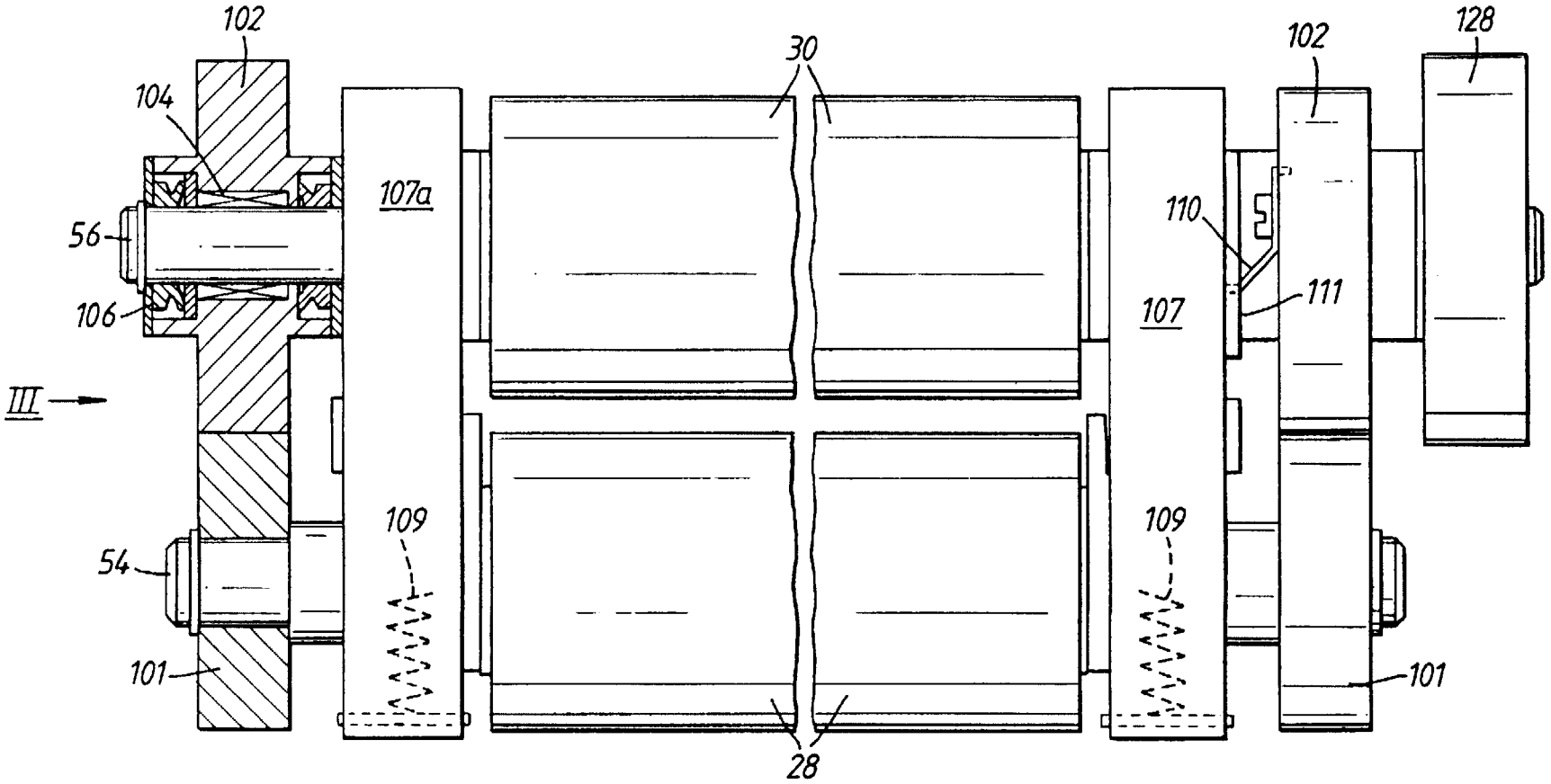
FIG. 2 is a plan view, partly cut-away, showing the valve operating mechanism associated with the apparatus shown in FIG. 1.

With reference to FIG. 2, each of the rollers is constructed by assembling the hollow cylindrical core covered with the elastomer, and fitted at each end of the core a rigid flange and a shaft, indicated by the references 54 and 56.

Figure 3:
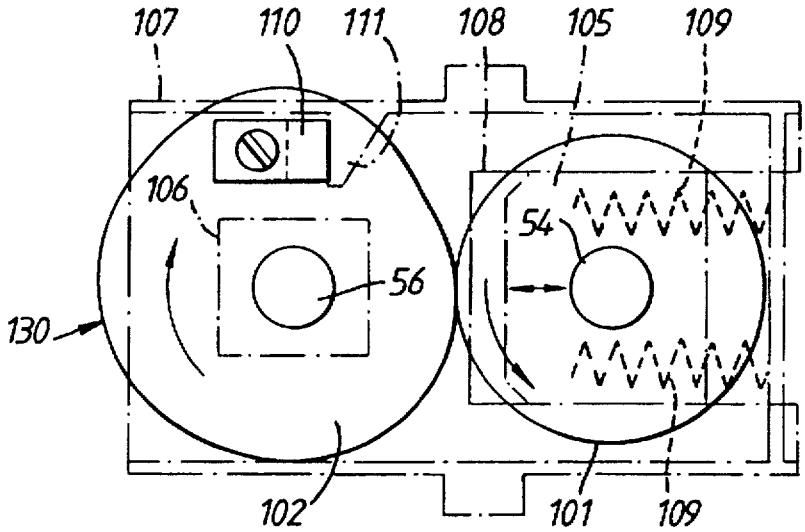
FIG. 3 is an end view, taken in the direction of the arrow III in FIG. 2, of the part of the valve operating mechanism shown in FIG. 2 in closed condition.
Figure 4:
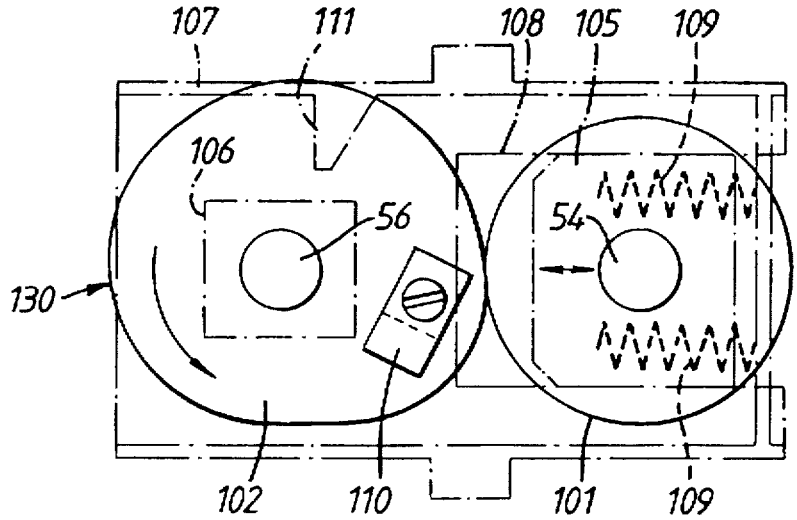
FIG. 4 is a similar end view of the part of the valve operating mechanism shown in FIG. 2 in open condition.

The valve operating mechanism is shown in FIGS. 2, 3 and 4. From FIG. 2 it will be seen that the rotation shafts 54, 56 of the first and second rollers 28, 30 respectively have cams 101, 102 secured thereto at each end thereof. The cams 101 on the first roller shaft 54 are circular and may be fixed for rotation with the shaft 54. If the cams 101 are made from an engineering polymer such as nylon or acetyl resin, then the cams 101 may be rotatable on the shaft 54 when no load is applied to the cams and will be held fixed on the shaft by friction when a load is applied to the cams 101. The cams 102 on the second roller shaft 56 are eccentric, and are secured on the shaft 56 through a one-way clutch or bearing mechanism 104 which allows the cams 102 to rotate relative to the shaft 56 in one direction (the "processing" direction), but locks the cams relative to the shaft 56 in the other direction of rotation (this is shown on one side of FIG. 2 only). The one-way mechanism 104 is sealed on the shaft 56 to prevent contamination. The rollers can be connected by gears, provided that the amplitude of the cam is smaller than the insertion depth of the gears.

The second roller 30 is a driven roller and the first roller 28 is an idle roller. The two roller shafts 54, 56 rotate in bearings 105, 106 respectively which are held in a pair of frames 107 located one at each end of the rollers. The second roller 30 rotates in bearing 106 fixed in the frames 107 and is rotated by a drive wheel 128 driven from an electric reversible step drive motor via transmission means, not shown. The motor is provided with an encoding disc system in order to control the speed and the progressing vertical position of the sheet material. The first roller 28 rotates in its bearings 105 and the bearings 105 slide in guides 108 in frames 107 so that the first roller 28 is free to move towards and away from the second roller 30 as the bearings 105 move between the positions shown in FIGS. 3 and 4. Springs 109 bias the first roller 28 towards the second roller 30 by a force of up to 400N. The first roller 28 is free to move between 1 and 6 mm away from the second roller in order to open the valve.

The eccentric cams 102 on the second roller 30 are held in an "at rest" position during the processing direction of rotation by an index clip 110 which rests against an abutment 111 on the respective frame 107. This sets the starting position for the operation of the eccentric cams 102 when second roller shaft 56 rotates in the opposite direction of rotation. For example, the rollers may be made to move apart over the first 180° to 210° of rotation of the second cam 102 relative to the first cam 101, be held apart at a preset distance for 60° of rotation, and then move together over the last 120° to 90° of movement.

Thus in FIG. 3 with the second roller 30 on shaft 56 rotating clockwise, i.e. in the processing direction, and the two rollers 28, 30 biased together by the springs 109, the first roller 28 on shaft 54 is driven anti-clockwise to pass sheet material through the rollers.

When the second roller 30 is driven clockwise, the cam 102 rotates on its one-way clutch 104 and is held stationary relative to the frame 107.

When the direction of rotation of the second roller 30 is reversed, i.e. to the valve-opening direction, the cam 102 now turns with the second roller and its cam surface 130 works against the circular cam 101 to push the first roller 28 against the bias of the springs 109 away from the second roller 30 (see FIGS. 2 and 4) to open the rollers and thereby allow cleaning liquid to pass by gravity into the next lower cell.

We claim:

1. A method of cleaning a photographic sheet material processing apparatus having a plurality of treatment cells mounted one above another in a vertical stack to define a substantially vertical sheet material path through the apparatus, the method being characterised by the steps of:

(i) draining treatment liquid from said cells;

(ii) feeding a cleaning liquid to a first cell;

(iii) allowing at least a portion of said cleaning liquid to pass by gravity from said first cell to at least one further cell; and (iv) discharging said cleaning liquid from the apparatus.

2. A method according to claim 1, wherein said cleaning liquid is caused to pass to each cell in said stack in turn, from the top-most cell to the bottom-most cell.

3. A method according to claim 1, wherein said first cell is a photographic sheet material developing cell and said further cell is a photographic sheet material fixing cell.

4. A method according to claim 1, wherein at least said first cell comprises valve means, step (iii) including opening said valve means to allow cleaning liquid to pass by gravity to the next lower cell.

5. A method according to claim 4, wherein said valve means is constituted by a roller in contact with a reaction surface in a processing mode of the apparatus to define a nip through which the sheet material passes during processing, and wherein said valve means is opened during a cleaning mode of the apparatus by moving said roller away from said reaction surface.

6. A method according to claim 1, wherein all the cleaning liquid in said first cell is allowed to pass by gravity to said further cell.

7. A method according to claim 1, wherein said cleaning liquid comprises water.

8. A method according to claim 1, wherein said cleaning liquid is circulated through said first cell before being allowed to pass by gravity to said further cell.

9. A method according to claim 1, wherein at least one of said treatment liquids is drained into a container, to be re-used after cleaning of the associated cell is complete.

10. A photographic sheet material processing apparatus having a plurality of treatment cells mounted one above another in a vertical stack to define a substantially vertical sheet material path through the apparatus, characterised by means for feeding cleaning liquid to a first cell, means for allowing at least a portion of said cleaning liquid to pass by gravity to a further cell and means for discharging said cleaning liquid from the apparatus.

11. An apparatus according to claim 10, wherein at least said first cell comprises a rotatable roller biased towards a reaction surface, the roller and said reaction surface being relatively movable between a position in which said roller is in contact with said reaction surface to define a nip through which said sheet material path extends and a position in which said roller is moved apart from said reaction surface to allow cleaning liquid to pass by gravity to the next lower cell.

* * * * *